US008197936B2

(12) United States Patent
Keshavan

(10) Patent No.: US 8,197,936 B2
(45) Date of Patent: Jun. 12, 2012

(54) CUTTING STRUCTURES

(75) Inventor: Madapusi K. Keshavan, The Woodlands, TX (US)

(73) Assignee: Smith International, Inc., Houston, TX (US)

( * ) Notice: Subject to any disclaimer, the term of this patent is extended or adjusted under 35 U.S.C. 154(b) by 921 days.

(21) Appl. No.: 12/236,083

(22) Filed: Sep. 23, 2008

(65) Prior Publication Data

US 2009/0022952 A1 Jan. 22, 2009

Related U.S. Application Data

(63) Continuation-in-part of application No. 11/044,651, filed on Jan. 27, 2005, now Pat. No. 7,435,478.

(51) Int. Cl.
*B32B 9/00* (2006.01)

(52) U.S. Cl. ..... 428/408; 428/212; 428/698; 428/704

(58) Field of Classification Search ..... 51/307, 51/309; 428/212, 408, 698, 704
See application file for complete search history.

(56) References Cited

U.S. PATENT DOCUMENTS

| | | | |
|---|---|---|---|
| 2,941,241 | A | 6/1960 | STrong |
| 2,941,248 | A | 6/1960 | Hall |
| 2,947,611 | A | 8/1960 | Bundy |
| 3,136,615 | A | 6/1964 | Bovenkerk et al. |
| 3,141,746 | A | 7/1964 | De Lai |
| 3,233,988 | A | 2/1966 | Wentorf, Jr. et al. |
| 3,609,818 | A | 10/1971 | Wentorf, Jr. |
| 3,745,623 | A | 7/1973 | Wentorf, Jr. et al. |
| 3,767,371 | A | 10/1973 | Wentorf, Jr. et al. |
| 4,104,344 | A | 8/1978 | Pope et al. |
| 4,108,614 | A | 8/1978 | Mitchell |
| 4,151,686 | A | 5/1979 | Lee et al. |
| 4,224,380 | A | 9/1980 | Bovenkerk et al. |
| 4,255,165 | A | 3/1981 | Dennis et al. |
| 4,268,276 | A | 5/1981 | Bovenkerk |
| 4,288,248 | A | 9/1981 | Bovenkerk et al. |
| 4,289,503 | A | 9/1981 | Corrigan |
| 4,303,442 | A | 12/1981 | Hara et al. |
| 4,311,490 | A | 1/1982 | Bovenkerk et al. |
| 4,373,593 | A | 2/1983 | Phaal et al. |
| 4,387,287 | A | 6/1983 | Marazzi |
| 4,412,980 | A | 11/1983 | Tsuji et al. |
| 4,481,016 | A | 11/1984 | Campbell et al. |
| 4,486,286 | A | 12/1984 | Lewin et al. |
| 4,504,519 | A | 3/1985 | Zelez |

(Continued)

FOREIGN PATENT DOCUMENTS

| | | | |
|---|---|---|---|
| EP | 0300699 | A2 | 1/1989 |

(Continued)

OTHER PUBLICATIONS

Combined Search and Examination Report issued in Application No. GB0916441.9, mailed on Dec. 2, 2009 (3 pages).

*Primary Examiner* — Archene Turner
(74) *Attorney, Agent, or Firm* — Osha • Liang LLP

(57) ABSTRACT

A polycrystalline diamond compact cutter that includes a thermally stable polycrystalline diamond layer, a carbide substrate, and a polycrystalline cubic boron nitride layer interposed between the thermally stable polycrystalline diamond layer and the carbide substrate such that at least a portion of the polycrystalline cubic boron nitride layer is radially surrounded by the thermally stable polycrystalline diamond layer is disclosed.

31 Claims, 4 Drawing Sheets

U.S. PATENT DOCUMENTS 4,522,633 A 6/1985 Dyer
4,525,179 A 6/1985 Gigl
4,534,773 A 8/1985 Phaal et al.
4,556,403 A 12/1985 Almond et al.
4,560,014 A 12/1985 Geczy
4,570,726 A 2/1986 Hall
4,572,722 A 2/1986 Dyer
4,604,106 A 8/1986 Hall
4,605,343 A 8/1986 Hibbs, Jr. et al.
4,606,738 A 8/1986 Hayden
4,621,031 A 11/1986 Scruggs
4,636,253 A 1/1987 Nakai et al.
4,645,977 A 2/1987 Kurokawa et al.
4,664,705 A 5/1987 Horton et al.
4,670,025 A 6/1987 Pipkin
4,673,414 A 6/1987 Lavens et al.
4,707,384 A 11/1987 Schachner et al.
4,726,718 A 2/1988 Meskin et al.
4,766,040 A 8/1988 Hillert et al.
4,776,861 A 10/1988 Frushour
4,784,023 A 11/1988 Dennis
4,792,001 A 12/1988 Zijsling
4,793,828 A 12/1988 Burnand
4,797,241 A 1/1989 Peterson et al.
4,802,539 A 2/1989 Hall et al.
4,807,402 A 2/1989 Rai
4,828,582 A 5/1989 Frushour
4,844,185 A 7/1989 Newton, Jr. et al.
4,854,405 A 8/1989 Stroud
4,861,350 A 8/1989 Phaal et al.
4,871,377 A 10/1989 Frushour
4,882,128 A 11/1989 Hukvari et al.
4,899,922 A 2/1990 Slutz et al.
4,919,220 A 4/1990 Fuller et al.
4,931,068 A 6/1990 Dismukes et al.
4,933,529 A 6/1990 Saville
4,940,180 A 7/1990 Martell
4,943,488 A 7/1990 Sung et al.
4,944,772 A 7/1990 Cho
4,954,139 A 9/1990 Cerutti
4,976,324 A 12/1990 Tibbitts
5,011,514 A 4/1991 Cho et al.
5,027,912 A 7/1991 Juergens
5,030,276 A 7/1991 Sung et al.
5,032,147 A 7/1991 Frushour
5,068,148 A 11/1991 Nakahara et al.
5,092,687 A 3/1992 Hall
5,116,568 A 5/1992 Sung et al.
5,127,923 A 7/1992 Bunting et al.
5,135,061 A 8/1992 Newton, Jr.
5,176,720 A 1/1993 Martell et al.
5,186,268 A 2/1993 Clegg et al.
5,186,725 A 2/1993 Martell et al.
5,199,832 A 4/1993 Meskin et al.
5,205,684 A 4/1993 Meskin et al.
5,213,248 A 5/1993 Horton et al.
5,238,074 A 8/1993 Tibbitts et al.
5,264,283 A 11/1993 Waldenstrom et al.
5,337,844 A 8/1994 Tibbitts
5,355,969 A 10/1994 Hardy et al.
5,370,195 A 12/1994 Keshavan et al.
5,379,853 A 1/1995 Lockwood et al.
5,439,492 A 8/1995 Anthony et al.
5,464,068 A 11/1995 Najafi-Sani
5,468,268 A 11/1995 Tank et al.
5,494,477 A 2/1996 Flood et al.
5,496,638 A 3/1996 Waldenstrom et al.
5,505,748 A 4/1996 Tank et al.
5,510,193 A 4/1996 Cerutti
5,523,121 A 6/1996 Anthony et al.
5,524,719 A 6/1996 Dennis
5,560,716 A 10/1996 Tank et al.
5,607,024 A 3/1997 Keith et al.
5,620,382 A 4/1997 Cho et al.
5,624,068 A 4/1997 Waldenstrom et al.
5,645,617 A 7/1997 Frushour
5,662,720 A 9/1997 O'Tighearnaigh et al.
5,667,028 A 9/1997 Truax et al.
5,718,948 A 2/1998 Ederyd et al.
5,722,497 A 3/1998 Gum et al.
5,722,499 A 3/1998 Nguyen et al.
5,776,615 A 7/1998 Wong et al.
5,833,021 A 11/1998 Mensa-Wilmot et al.
5,875,862 A 3/1999 Jurewicz et al.
5,897,942 A 4/1999 Karner et al.
5,935,323 A 8/1999 Tanga et al.
5,954,147 A 9/1999 Overstreet et al.
5,979,578 A 11/1999 Packer
6,009,963 A 1/2000 Chaves et al.
6,063,333 A 5/2000 Dennis
6,098,730 A 8/2000 Scott et al.
6,123,612 A 9/2000 Goers
6,126,741 A 10/2000 Jones et al.
6,165,616 A 12/2000 Lemelson et al.
6,202,770 B1 3/2001 Jurewicz et al.
6,234,261 B1 5/2001 Evans et al.
6,248,447 B1 6/2001 Griffin et al.
6,269,894 B1 8/2001 Griffin
6,302,225 B1 10/2001 Yoshida et al.
6,315,065 B1 11/2001 Yong et al.
6,332,503 B1 12/2001 Pessier et al.
6,367,568 B2 4/2002 Steinke et al.
6,410,085 B1 6/2002 Griffin et al.
6,435,058 B1 8/2002 Matthias et al.
6,443,248 B2 9/2002 Yong et al.
6,544,308 B2 4/2003 Griffin et al.
6,550,556 B2 4/2003 Middlemiss et al.
6,562,462 B2 5/2003 Griffin et al.
6,585,064 B2 7/2003 Griffin et al.
6,589,640 B2 7/2003 Griffin et al.
6,601,662 B2 8/2003 Matthias et al.
6,739,214 B2 5/2004 Griffin et al.
6,749,033 B2 6/2004 Griffin et al.
6,797,326 B2 9/2004 Griffin et al.
6,892,836 B1 5/2005 Eyre et al.
6,904,984 B1 6/2005 Estes et al.
6,935,444 B2 8/2005 Lund et al.
6,991,049 B2 1/2006 Eyre et al.
7,377,341 B2 5/2008 Middlemiss et al.
7,435,478 B2 * 10/2008 Keshavan ..... 428/408
2002/0071729 A1 6/2002 Middlemiss et al.
2005/0050801 A1 3/2005 Cho et al.
2005/0129950 A1 6/2005 Griffin et al.
2005/0230156 A1 10/2005 Belnap et al.
2005/0263328 A1 12/2005 Middlemiss
2006/0060390 A1 3/2006 Eyre
2006/0060392 A1 3/2006 Eyre
2006/0162969 A1 7/2006 Belnap et al.
2006/0165993 A1 7/2006 Keshavan
2006/0191723 A1 8/2006 Keshavan
2006/0207802 A1 9/2006 Zhang et al.
2006/0266558 A1 11/2006 Middlemiss et al.
2007/0079994 A1 4/2007 Middlemiss
2007/0169419 A1 7/2007 Davis et al.
2007/0181348 A1 8/2007 Lancaster et al.
2007/0187155 A1 8/2007 Middlemiss
2008/0073126 A1 3/2008 Shen et al.
2008/0085407 A1 4/2008 Cooley et al.
2008/0142276 A1 6/2008 Griffo et al.
2008/0185189 A1 8/2008 Griffo et al.
2008/0223621 A1 9/2008 Middlemiss et al.
2008/0223623 A1 9/2008 Keshavan et al.
2008/0230280 A1 9/2008 Keshavan et al.
2009/0032169 A1 2/2009 Dourfaye et al.
2009/0152017 A1 6/2009 Shen et al.

FOREIGN PATENT DOCUMENTS

EP 0329954 A2 8/1989
EP 0500253 8/1992
EP 0595630 A1 5/1994
EP 0595631 A1 5/1994
EP 0612868 A1 8/1994
EP 0617207 A2 9/1994
EP 0787820 A2 8/1997
EP 0860515 A1 8/1998
EP 1116858 A1 7/2001
EP 1190791 A2 3/2002

| | | | | |
|---|---|---|---|---|
| EP | 1958688 | A1 | | 8/2008 |
| GB | 1349385 | A | | 4/1974 |
| GB | 2048927 | A | | 12/1980 |
| GB | 2268768 | A | | 1/1994 |
| GB | 2270493 | A | | 3/1994 |
| GB | 2323398 | A | | 9/1998 |
| GB | 2 335 682 | | | 9/1999 |
| GB | 2351747 | A | | 1/2001 |
| GB | 2367081 | A | | 3/2002 |
| GB | 2408735 | A | | 6/2005 |
| GB | 2413575 | A | | 11/2005 |
| GB | 2418215 | A | | 3/2006 |
| GB | 2422623 | A | | 8/2006 |
| GB | 2427215 | A | | 12/2006 |
| GB | 2429471 | A | | 2/2007 |
| GB | 2429727 | A | | 3/2007 |
| GB | 2447776 | A | | 9/2008 |
| SU | 2034937 | | * | 5/1991 |
| WO | 9323204 | A1 | | 11/1993 |
| WO | 0028106 | A1 | | 5/2000 |
| WO | 2004040095 | A1 | | 5/2004 |
| WO | 2004106003 | A1 | | 12/2004 |
| WO | 2004106004 | A1 | | 12/2004 |
| WO | 2007042920 | A1 | | 4/2007 |

* cited by examiner

CUTTING STRUCTURES

CROSS-REFERENCE TO RELATED APPLICATIONS

This application is a continuation-in-part, and claims benefit under 35 U.S.C. §120, of U.S. patent application Ser. No. 11/044,651, which is hereby incorporated by reference in its entirety.

BACKGROUND OF INVENTION

1. Field of the Invention

The invention relates generally to drill bits which have polycrystalline diamond compact ("PDC") cutters thereon. More particularly, this invention relates to drill bits which have polycrystalline diamond cutting structures that have a high thermal stability.

2. Background Art

Polycrystalline diamond compact (PDC) cutters have been used in industrial applications including rock drilling and metal machining for many years. In a typical application, a compact of polycrystalline diamond (PCD) (or other superhard material) is bonded to a substrate material, which is typically a sintered metal-carbide to form a cutting structure. PCD comprises a polycrystalline mass of diamonds (typically synthetic) that are bonded together to form an integral, tough, high-strength mass or lattice. The resulting structure produces enhanced properties of wear resistance and hardness, making polycrystalline diamond materials extremely useful in aggressive wear and cutting applications where high levels of wear resistance and hardness are desired.

Conventional PCD includes 85-95% by volume diamond and a balance of the binder material, which is present in PCD within the interstices existing between the bonded diamond grains. Binder materials that are typically used in forming PCD include Group VIII elements, with cobalt (Co) being the most common binder material used.

An example of a rock bit for earth formation drilling using PDC cutters is disclosed in U.S. Pat. No. 5,186,268. FIGS. 1 and 2 from that patent show a rotary drill having a bit body 10. The lower face of the bit body 10 is formed with a plurality of blades 16-25, which extend generally outwardly away from a central longitudinal axis of rotation 15 of the drill bit. A plurality of PDC cutters 26 are disposed side by side along the length of each blade. The number of PDC cutters 26 carried by each blade may vary. The PDC cutters 26 are individually brazed to a stud-like carrier (or substrate), which may be formed from tungsten carbide, and are received and secured within sockets in the respective blade.

A PDC cutter may be formed by placing a cemented carbide substrate into the container of a press. A mixture of diamond grains or diamond grains and catalyst binder is placed atop the substrate and treated under high pressure/high temperature (HPHT) conditions. In doing so, metal binder (often cobalt) migrates from the substrate and passes through the diamond grains to promote intergrowth between the diamond grains. As a result, the diamond grains become bonded to each other to form the diamond layer, and the diamond layer is in turn bonded to the substrate. The substrate often comprises a metal-carbide composite material, such as tungsten carbide. The deposited diamond layer is often referred to as the "diamond table" or "abrasive layer."

One of the major factors in determining the longevity of PDC cutters is the strength of the bond between the PCD layer and the sintered metal carbide substrate. For example, analyses of the failure mode for drill bits used for earth formation drilling show that in approximately one-third of the cases, bit failure or wear is caused by delamination of the diamond table from the metal carbide surface.

Many prior art PDC cutters have the diamond table deposited on a substrate having a planar interface. However, in an attempt to reduce the incidents of delamination at the PCD/metal carbide interface, several prior art systems have incorporated substrates having a non-planar geometry to form a non-planar interface. U.S. Pat. No. 5,494,477 discloses cutters having a non-planar interface. FIG. 3 illustrates one embodiment of a PDC cutter having a non-planar interface. As shown in FIG. 3, PDC 110 includes a plurality of sloped surfaces 114, 115 between the substrate 111 and the abrasive layer 112.

Additionally, other prior art systems have incorporated an intermediate layer between the diamond layer and the substrate to reduce these stresses. U.S. Pat. No. 5,510,193 discloses an intermediate layer of polycrystalline cubic boron nitride between a PDC layer and a cemented metal carbide support layer. Further, in the '193 patent, the metal binder, i.e., cobalt, is substantially swept from the metal carbide support layer into the intermediate layer and into the PDC layer. The '193 patent contributes the observed physical properties and interlayer bond strengths of the '193 compact to the sweeping through of the cobalt into the intermediate and PDC layers.

Furthermore, an additional factor in determining the longevity of PDC cutters is the heat that is produced at the cutter contact point, specifically at the exposed part of the PCD layer caused by friction between the PCD and the work material. The thermal operating range of PDC cutters is typically 750° C. or less; conventional PCD is stable at temperatures of up to 700-750° C. Temperatures higher than 750° C. may result in permanent damage to and structural failure of the PCD as well as rapid wear of the cutter due to the significant difference in the coefficient of thermal expansion of the binder material, cobalt, as compared to diamond. Upon heating of polycrystalline diamond, the cobalt and the diamond lattice expand at different rates, which may cause cracks to form in the diamond lattice structure and result in deterioration of the polycrystalline diamond. This may result in spalling of the PCD layer, delamination between the PCD and substrate, and back conversion of the diamond to graphite causing rapid abrasive wear, loss of microstructural integrity, and strength loss. This thermal expansion also jeopardizes the bond strength between the diamond table and the carbide substrate.

In order to overcome this problem, strong acids may be used to "leach" the cobalt from the diamond lattice structure (either a thin volume or entire tablet) to at least reduce the damage experienced from heating diamond-cobalt composite at different rates upon heating. Examples of "leaching" processes can be found, for example, in U.S. Pat. Nos. 4,288,248 and 4,104,344. Briefly, a strong acid, typically nitric acid or combinations of several strong acids (such as nitric and hydrofluoric acid) may be used to treat the diamond table, removing at least a portion of the Co-catalyst from the PCD composite. By leaching out the cobalt, thermally stable polycrystalline ("TSP") diamond may be formed. In certain embodiments, only a select portion of a diamond composite is leached, in order to gain thermal stability without losing impact resistance. As used herein, the term TSP includes both of the above (i.e., partially and completely leached) compounds. Interstitial volumes remaining after leaching may be reduced by either furthering consolidation or by filling the volume with a secondary material, such by processes known in the art and described in U.S. Pat. No. 5,127,923, which is herein incorporated by reference in its entirety.

Accordingly, there exists a need for thermally stable PDC cutters having a decreased risk of delamination.

SUMMARY OF INVENTION

In one aspect, the present disclosure relates to a polycrystalline diamond compact cutter that includes a thermally stable polycrystalline diamond layer, a carbide substrate, and a polycrystalline cubic boron nitride layer interposed between the thermally stable polycrystalline diamond layer and the carbide substrate such that at least a portion of the polycrystalline cubic boron nitride layer is radially surrounded by the thermally stable polycrystalline diamond layer.

In another aspect, the disclosure relates to a polycrystalline diamond compact cutter that includes a thermally stable polycrystalline diamond layer, a carbide substrate, and at least two polycrystalline cubic boron nitride layers interposed between the thermally stable polycrystalline diamond layer and the carbide substrate such that at least a portion of at least one of the at least two polycrystalline cubic boron nitride layers is radially surrounded by the thermally stable polycrystalline diamond layer.

Other aspects and advantages of the invention will be apparent from the following description and the appended claims.

DETAILED DESCRIPTION

In one aspect, embodiments of the disclosure relate to a polycrystalline diamond compact (PDC) cutter disposed on a support. In particular, embodiments of the present disclosure relate to a thermally stable polycrystalline diamond compact cutter for use with a PDC bit. Moreover, the disclosure relates to a method for forming such cutters.

As used herein, the term "PCD" refers to polycrystalline diamond that has been formed, at high pressure/high temperature (HPHT) conditions, through the use of a solvent metal catalyst, such as those included in Group VIII of the Periodic table. The term "thermally stable polycrystalline diamond," as used herein, refers to intercrystalline bonded diamond that includes a volume or region that has been rendered substantially free of the solvent metal catalyst used to form PCD, or the solvent metal catalyst used to form PCD remains in the region of the diamond body but is otherwise reacted or rendered ineffective in its ability to adversely impact the bonded diamond at elevated temperatures as discussed above.

Figure 1:
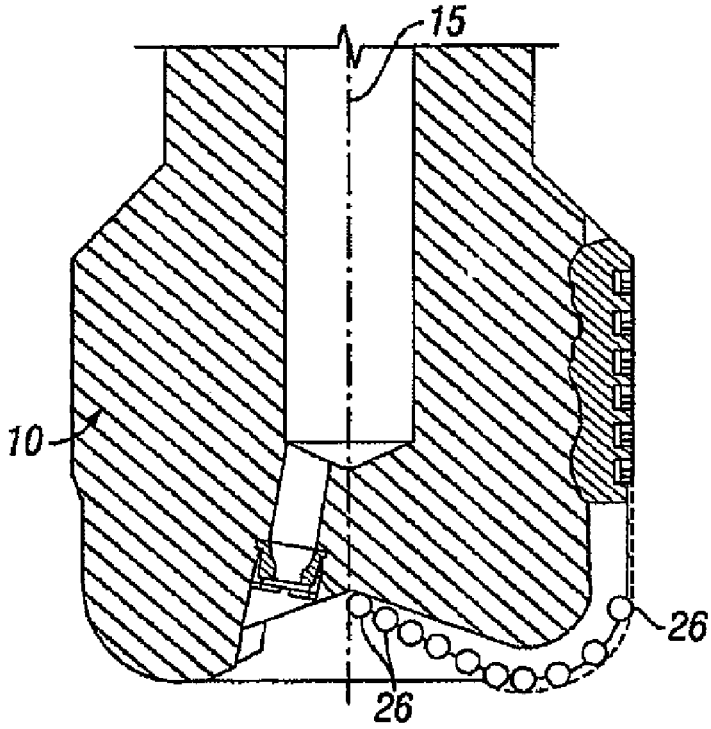
FIG. 1 (Prior Art)
FIG. 1 is an illustration of a prior art drill bit having PDC cutters.
Figure 2:
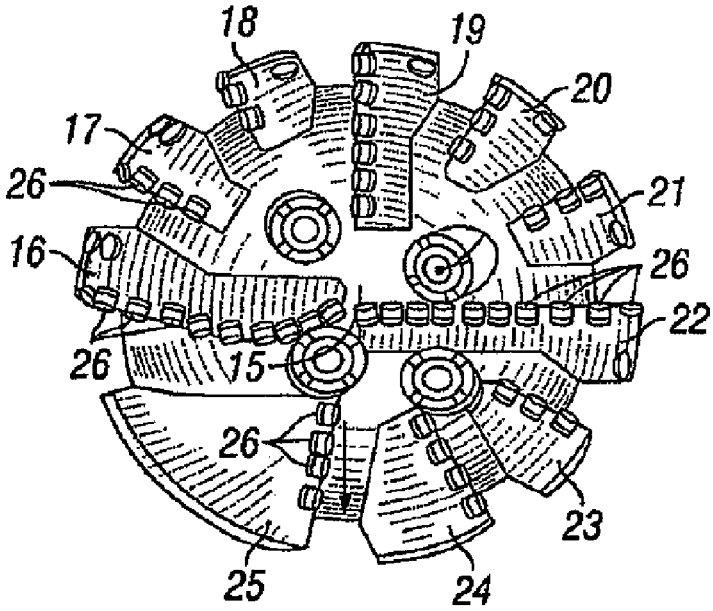
FIG. 2 (Prior Art)
FIG. 2 is an illustration of a prior art drill bit having PDC cutters.
Figure 3:
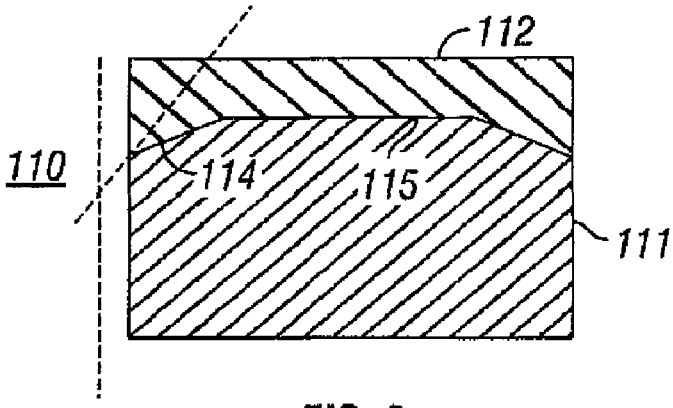
FIG. 3 (Prior Art)
FIG. 3 is an illustration of a cross-sectional view of a prior art PDC cutter having a non-planar surface.
Figure 4:
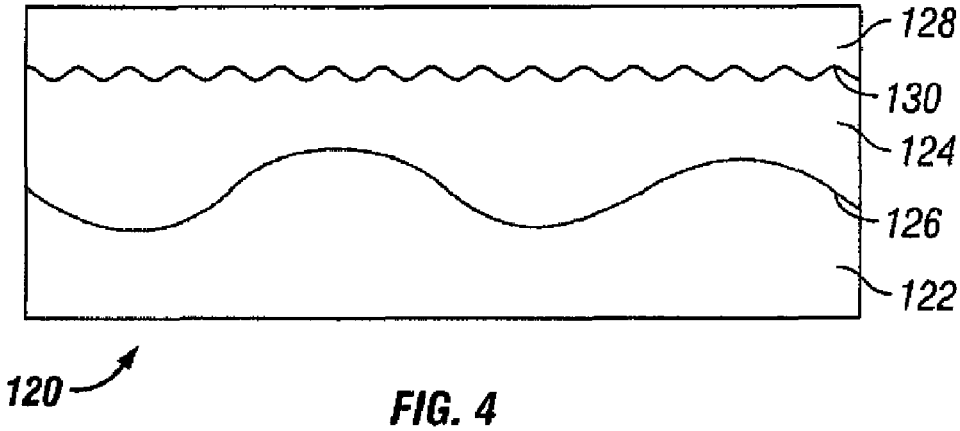
FIG. 4 illustrates one embodiment of a PDC cutter in accordance with the present invention.

Referring to FIG. 4, a novel cutting element in accordance with an embodiment of the disclosure is shown. In this embodiment, as shown in FIG. 4, the PDC cutter 120 includes an underlying layer of a carbide substrate 122. A polycrystalline cubic boron nitride layer 124 is disposed on the carbide substrate 122, creating a first interface 126 between the carbide substrate 122 and the polycrystalline cubic boron nitride layer 124. A thermally stable polycrystalline diamond compact layer 128 is disposed on the polycrystalline cubic boron nitride layer 124, creating a second interface 130 between the polycrystalline cubic boron nitride layer 124 and the thermally stable polycrystalline diamond compact layer 128. According to the embodiment shown in FIG. 4 the first interface 126 and the second interface 130 have non-planar geometries. In accordance with some embodiments of the disclosure, the first interface 126 and/or the second interface 130 have planar geometries (not shown separately). In this particular embodiment, a tungsten carbide substrate is used.

Figure 5:
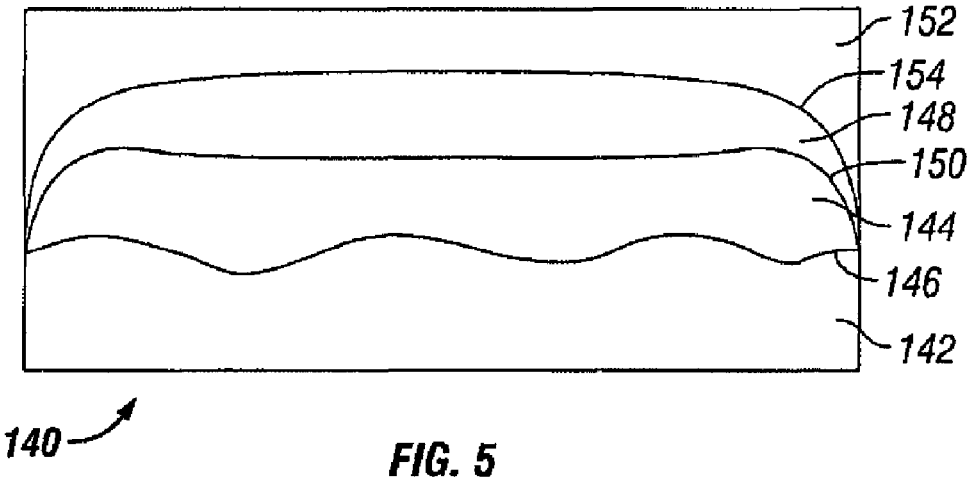
FIG. 5 illustrates one embodiment of a PDC cutter in accordance with the present invention.

Referring to FIG. 5, a second PDC cutter in accordance with an embodiment of the present disclosure is shown. In this embodiment, as shown in FIG. 5, the PDC cutter 140 includes a carbide substrate 142. A first polycrystalline cubic boron nitride layer 144 is disposed on the carbide substrate 142 creating a first interface 146 between the carbide substrate 142 and the first polycrystalline cubic boron nitride layer 144. A second polycrystalline cubic boron nitride layer 148 is disposed on the first polycrystalline cubic boron nitride layer 144 creating a second interface 150 between the first polycrystalline cubic boron nitride layer 144 and the second polycrystalline cubic boron nitride layer 148. A thermally stable polycrystalline diamond compact layer 152 is disposed on and radially surrounds at least a portion of the second polycrystalline cubic boron nitride layer 148, creating a third interface 154 between the second polycrystalline cubic boron nitride layer 148 and the thermally stable polycrystalline diamond compact layer 152.

Figure 6:
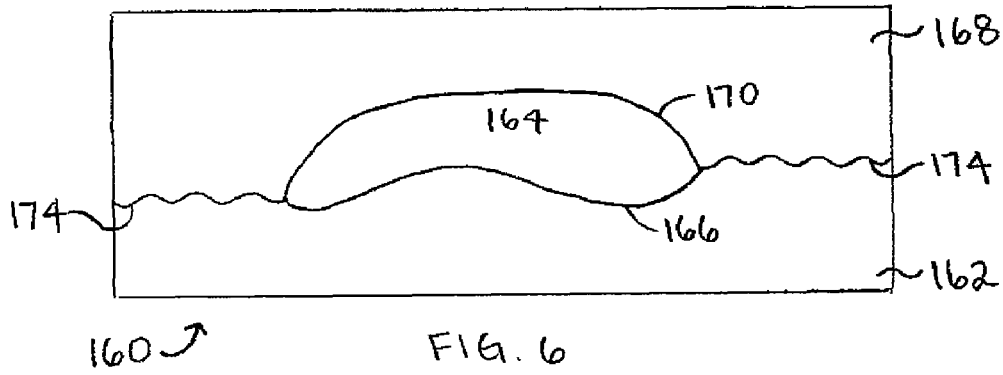
FIG. 6 illustrates one embodiment of a PDC cutter in accordance with the present invention.

Referring to FIG. 6, a novel cutting element in accordance with an embodiment of the disclosure is shown. In this embodiment, as shown in FIG. 6, the PDC cutter 160 includes an underlying layer of a carbide substrate 162. A polycrystalline cubic boron nitride layer 164 is disposed on a radially interior portion of the upper surface of the carbide substrate 162, creating a first interface 166 between the carbide substrate 162 and the polycrystalline cubic boron nitride layer 164. A thermally stable polycrystalline diamond compact layer 168 is disposed on the polycrystalline cubic boron nitride layer 164 and at least a portion of the carbide substrate 162 such that the thermally stable polycrystalline diamond compact layer 168 completely encompasses and radially surrounds the polycrystalline cubic boron nitride layer 164, creating an interface 170 between the polycrystalline cubic boron nitride layer 164 and the thermally stable polycrystalline diamond compact layer 168 and an interface 174 between the thermally stable polycrystalline diamond compact layer 168 and carbide substrate 162. According to the embodiment shown in FIG. 6, the interfaces 166, 170, and 174, have non-planar geometries. In accordance with some embodiments of the disclosure, any combination of these interfaces 166, 170, 174 may have planar geometries (not shown separately). In this particular embodiment, a tungsten carbide substrate is used.

Figure 7:
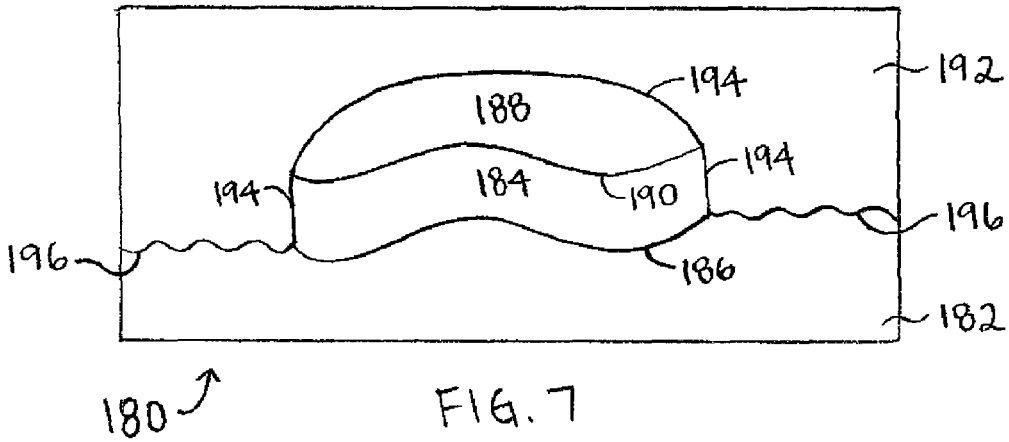
FIG. 7 illustrates one embodiment of a PDC cutter in accordance with the present invention.

Referring to FIG. 7, another PDC cutter in accordance with an embodiment of the present disclosure is shown. In this embodiment, as shown in FIG. 7, the PDC cutter 180 includes a carbide substrate 182. A first polycrystalline cubic boron nitride layer 184 is disposed on a radially interior portion of the upper surface of the carbide substrate 182 creating a first interface 186 between the carbide substrate 182 and the first polycrystalline cubic boron nitride layer 184. A second polycrystalline cubic boron nitride layer 188 is disposed on at least a portion of the upper surface of the first polycrystalline cubic boron nitride layer 184 creating a second interface 190 between the first polycrystalline cubic boron nitride layer 184 and the second polycrystalline cubic boron nitride layer 188. A thermally stable polycrystalline diamond compact layer 192 is disposed on the second polycrystalline cubic boron nitride layer 188 and at least a portion of the carbide substrate 182 such that the thermally stable polycrystalline diamond compact layer 192 completely encompasses and radially surrounds both the first polycrystalline cubic boron nitride layer 184 and the second polycrystalline cubic boron nitride layer 188 creating an interface 194 between the two polycrystalline cubic boron nitride layers and the thermally stable polycrystalline diamond compact layer 192. Alternatively, although not shown, the second polycrystalline cubic boron nitride layer 188 may completely encompass and radially surround the first polycrystalline cubic boron nitride layer 184, creating both the second interface 190, described above, as well as another interface (not pictured) between the second polycrystalline cubic boron nitride layer 188 and the carbide substrate 182.

Figure 8:
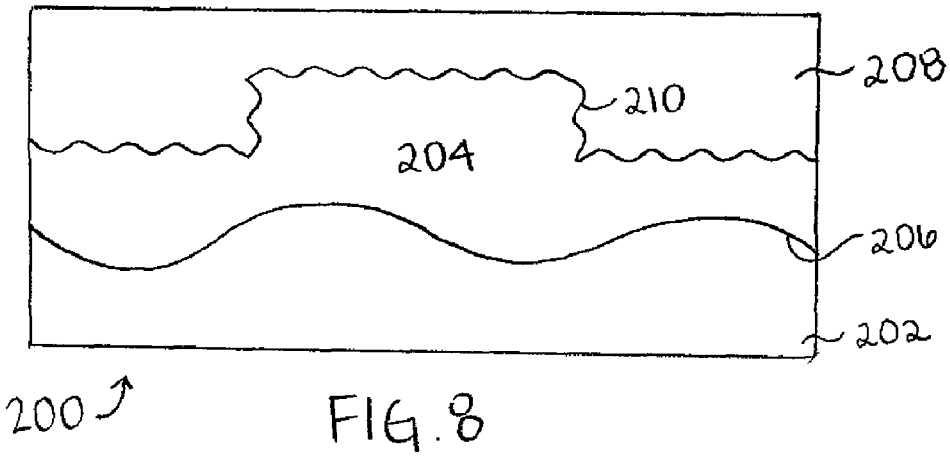
FIG. 8 illustrates one embodiment of a PDC cutter in accordance with the present invention.

Referring to FIG. 8, another PDC cutter in accordance with an embodiment of the present disclosure is shown. In this embodiment, as shown in FIG. 8, the PDC cutter 200 includes a carbide substrate 202. A polycrystalline cubic boron nitride layer 204 is disposed on the upper surface of the carbide substrate 202, creating a first interface 206 between the carbide substrate 202 and the polycrystalline cubic boron nitride layer 204. A thermally stable polycrystalline diamond compact layer 208 is disposed on the polycrystalline cubic boron nitride layer 204 such that the thermally stable polycrystalline diamond compact layer 208 radially surrounds at least a portion of the polycrystalline cubic boron nitride layer 204 creating an interface 210 between the polycrystalline cubic boron nitride layer 204 and the thermally stable polycrystalline diamond compact layer 208. According to the embodiment shown in FIG. 8, the interfaces (206 and 210) have non-planar geometries. In accordance with some embodiments of the disclosure, any combination of these interfaces (206 and 210) may have planar geometries (not shown separately). In this particular embodiment, a tungsten carbide substrate is used.

Figure 9:
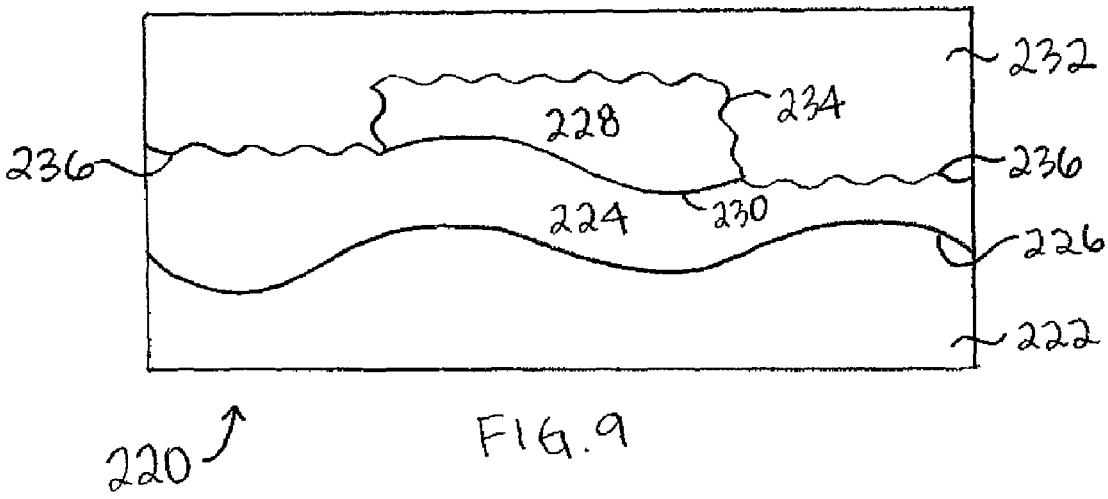
FIG. 9 illustrates one embodiment of a PDC cutter in accordance with the present invention.

Referring to FIG. 9, another PDC cutter in accordance with an embodiment of the present disclosure is shown. In this embodiment, as shown in FIG. 9, the PDC cutter 220 includes a carbide substrate 222. A first polycrystalline cubic boron nitride layer 224 is disposed on the upper surface of the carbide substrate 222, creating a first interface 226 between the carbide substrate 222 and the first polycrystalline cubic boron nitride layer 224. A second polycrystalline cubic boron nitride layer 228 is disposed on a radially interior portion of the upper surface of the first polycrystalline cubic boron nitride layer 224 creating a second interface 230 between the first polycrystalline cubic boron nitride layer 224 and the second polycrystalline cubic boron nitride layer 228 and leaving a radially exterior portion of the upper surface of the first polycrystalline cubic boron nitride layer 224 exposed. A thermally stable polycrystalline diamond compact layer 232 is disposed on the second polycrystalline cubic boron nitride layer 228 such that the second polycrystalline cubic boron nitride layer 228 is radially surrounded by the thermally stable polycrystalline diamond compact layer 232 creating a third interface 234 between the thermally stable polycrystalline diamond compact layer 232 and the second polycrystalline cubic boron nitride layer 228. The thermally stable polycrystalline diamond compact layer 232, while radially surrounding the second polycrystalline cubic boron nitride layer 228, is also disposed on the exposed radially exterior portion of the upper surface of the first polycrystalline cubic boron nitride layer 224 creating a fourth interface 236 between the thermally stable polycrystalline diamond compact layer 232 and the first polycrystalline cubic boron nitride layer 224. According to the embodiment shown in FIG. 9, the interfaces (226, 230, 234 and 236) have non-planar geometries. In accordance with some embodiments of the disclosure, any combination of these interfaces (226, 230, 234 and 236) may have planar geometries (not shown separately). In this particular embodiment, a tungsten carbide substrate is used.

Figure 10:
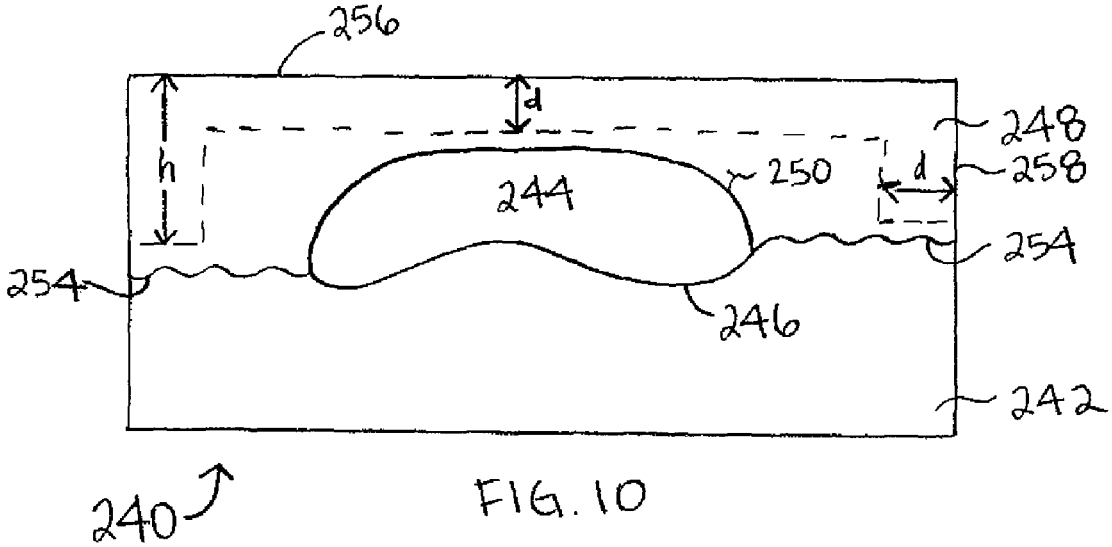
FIG. 10 illustrates one embodiment of a PDC cutter in accordance with the present invention.

Referring to FIG. 10, another PDC cutter in accordance with an embodiment of the disclosure is shown. In this embodiment, as shown in FIG. 10, the PDC cutter 240 includes an underlying layer of a carbide substrate 242. A polycrystalline cubic boron nitride layer 244 is disposed on a radially interior portion of the upper surface of the carbide substrate 242, creating a first interface 246 between the carbide substrate 242 and the polycrystalline cubic boron nitride layer 244. A polycrystalline diamond compact layer 248 is disposed on the polycrystalline cubic boron nitride layer 244 and at least a portion of the carbide substrate 242 such that the polycrystalline diamond compact layer 248 completely encompasses and radially surrounds the polycrystalline cubic boron nitride layer 244, creating an interface 250 between the polycrystalline cubic boron nitride layer 244 and the polycrystalline diamond compact layer 248 and an interface 254 between the polycrystalline diamond compact layer 248 and carbide substrate 242. The polycrystalline diamond compact layer 248 is treated to render a selected region thereof thermally stable. As shown in FIG. 10, the selected region of polycrystalline diamond compact layer 248 to be treated extends a distance h from an upper working or top surface 256 of the polycrystalline diamond layer 248 to the interface 254 between the polycrystalline diamond compact layer 248 and carbide substrate 242. Additionally, the selected region of polycrystalline diamond compact layer 248 to be treated may extend a distance d from both the upper working or top surface 256 and from the side surface 258 of the polycrystalline diamond layer 248 to the interface 250 between the polycrystalline cubic boron nitride layer 244 and the polycrystalline diamond compact layer 248. According to the embodiment shown in FIG. 10, the interfaces 246, 250, and 254, have non-planar geometries. In accordance with some embodiments of the disclosure, any combination of these interfaces 246, 250, 254 may have planar geometries (not shown separately). In this particular embodiment, a tungsten carbide substrate is used.

In one embodiment of the disclosure, the carbide substrate may include a metal carbide, such as tungsten carbide. The metal carbide grains may be supported within a metallic binder, such as cobalt. Additionally, the carbide substrate may be formed of a sintered tungsten carbide composite substrate. It is well known that various metal carbide compositions and binders may be used, in addition to tungsten carbide and cobalt. Further, references to the use of tungsten carbide and cobalt are for illustrative purposes only, and no limitation on the type of carbide or binder used is intended.

According to one embodiment of the disclosure, the polycrystalline cubic boron nitride interlayer includes a content of cubic boron nitride of at least 50% by volume by volume. According to another embodiment of the disclosure, the polycrystalline cubic boron nitride includes a content of cubic boron nitride of at least 70% by volume. According to yet another embodiment of the present disclosure, the polycrystalline cubic boron nitride layer includes a content of cubic boron nitride of at least 85% by volume.

In one embodiment of the present disclosure, the residual content of the polycrystalline cubic boron nitride interlayer may include at least one of Al, Si, and mixtures thereof, carbides, nitrides, carbonitrides and borides of Group 4a, 5a, and 6a transition metals of the periodic table. Mixtures and solid solutions of Al, Si, carbides, nitrides, carbonitrides and borides of Group 4a, 5a, and 6a transition metals of the periodic table may also be included.

In another embodiment of the present disclosure, the residual content of the polycrystalline diamond layer may include TiN, TiCN, TiAlCN or mixtures thereof and at least one aluminum containing material which may be selected from aluminum, aluminum nitride, aluminum diboride ($Al_6B_{12}$), and cobalt aluminide ($Co_2Al_9$). Cobalt aluminide may include compounds with different stoichiometries, such as $Co_2Al_5$; however, $Co_2Al_9$ is preferable since it has a melting temperature of 943° C., well below the melting temperature of the cobalt phase. Use of cobalt aluminide may provide for a polycrystalline cubic boron nitride layer having a higher proportion of cubic boron nitride, as well as greater intercrystalline bonding between cubic boron nitride.

The polycrystalline cubic boron nitride layer interposed between the polycrystalline diamond layer and the substrate may create a gradient with respect to the thermal expansion coefficients for the layers. The magnitude of the residual stresses at the interfaces depends on the disparity between the thermal expansion coefficients and elastic constants for various layers. The coefficient of thermal expansion for the metal substrate may be greater than that of the polycrystalline cubic boron nitride layer, which may be greater than that of the polycrystalline diamond layer.

In yet another embodiment, referring back to FIG. 4, the polycrystalline cubic boron nitride layer 124 may include at least two regions, an inner region and an outer region (not shown separately). The inner region and outer region of the polycrystalline cubic boron nitride layer differ from each other in their contents, specifically, in their cubic boron nitride contents. The outer region of the polycrystalline cubic boron nitride layer, for example, may contain a greater percentage by volume of cubic boron nitride as compared to the inner region of the polycrystalline cubic boron nitride layer.

The polycrystalline cubic boron nitride layer may be formed from a mass of cubic boron nitride particles disposed on the carbide substrate in a process involving high pressure and high temperature. Examples of high pressure, high temperature (HPHT) processes can be found, for example, in U.S. Pat. No. 5,510,193 issued to Cernetti, et al. Briefly, an unsintered mass of crystalline particles, such as diamond and cubic boron nitride, is placed within a metal enclosure of the reaction cell of a HPHT apparatus. With the crystalline particles, a metal catalyst, such as cobalt, and a pre-formed metal carbide substrate may be included with the unsintered mass of crystalline particles. The reaction cell is then placed under processing conditions sufficient to cause the intercrystalline bonding between particles. Additionally, if the metal carbide substrate was included, the processing conditions can join the sintered crystalline particles to the substrate. A suitable HPHT apparatus for this process is described in U.S. Pat. Nos. 2,947,611; 2,941,241; 2,941,248; 3,609,818; 3,767,371; 4,289,503; 4,673,414; and 4,954,139.

Application of HPHT processing will cause the cubic boron nitride particles to sinter and form a polycrystalline layer. Similarly, the polycrystalline diamond compact layer may be formed by placing a powdered mass of crystalline diamond particles on the polycrystalline cubic boron nitride layer and applying HPHT processing to effectuate a polycrystalline diamond compact layer.

Alternatively, the polycrystalline cubic boron nitride layer and the polycrystalline diamond compact layer may be formed simultaneously by placing a mass of cubic boron nitride particles on the carbide substrate and a mass of crystalline diamond particles on the mass of cubic boron nitride particles. Application of HPHT processing will effectively sinter both layers simultaneously. The polycrystalline diamond layer may be further treated so as to form a thermally stable polycrystalline diamond compact layer having a desired thickness (e.g., greater than 0.010 inches) at its cutting edge. The thermally stable polycrystalline diamond compact, the polycrystalline cubic boron nitride and the carbide substrate may be bonded together using any method known in the art for such bonding.

The composite material of the carbide substrate and each superhard material layer disposed thereon may be made according to methods, such as, forming the cutter assembly in a deep drawn metal cup, the inside of which is formed to the desired net shape of the end of the cutter to be preformed, as well as embedding the blended powders for making the layers of the cutter into a plastically deformable tape material, such as to form a layer which radially surrounds the other layers. Such methods are disclosed in U.S. Pat. No. 5,370,195 and are incorporated herein.

The polycrystalline diamond layer includes individual diamond "crystals" that are interconnected. The individual diamond crystals thus form a lattice structure. A metal catalyst, such as cobalt may be used to promote recrystallization of the diamond particles and formation of the lattice structure. Thus, cobalt particles are typically found within the interstitial spaces in the diamond lattice structure. Cobalt has a significantly different coefficient of thermal expansion as compared to diamond. Therefore, upon heating of a diamond table, the cobalt and the diamond lattice will expand at different rates, causing cracks to form in the lattice structure and resulting in deterioration of the diamond table.

In order to obviate this problem, the polycrystalline diamond body or compact may be treated to render a selected region thereof thermally stable. This can be done, for example, by removing substantially all of the catalyst material from the selected region by suitable process, e.g., strong acids may be used to "leach" the cobalt from the diamond lattice structure. Examples of "leaching" processes can be found, for example in U.S. Pat. Nos. 4,288,248 and 4,104,344. Briefly, a hot strong acid, e.g., nitric acid, hydrofluoric acid, hydrochloric acid, or perchloric acid, or combinations of several strong acids may be used to treat the diamond table, removing at least a portion of the catalyst from the PCD layer. By leaching out the cobalt, thermally stable polycrystalline (TSP) diamond may be formed. Alternatively, rather than actually removing the catalyst material from the polycrystalline diamond body or compact, the selected region of the polycrystalline diamond body or compact can be rendered thermally stable by treating the catalyst material in a manner that reduces or eliminates the potential for the catalyst material to adversely impact the intercrystalline bonded diamond at elevated temperatures. For example, the catalyst material can be combined chemically with another material to cause it to no longer act as a catalyst material, or can be transformed into another material that again causes it to no longer act as a catalyst material. Accordingly, as used herein, the terms "removing substantially all" or "substantially free" as used in reference to the catalyst material is intended to cover the different methods in which the catalyst material can be treated to no longer adversely impact the intercrystalline diamond in the polycrystalline diamond body or compact with increasing temperature. Additionally, the polycrystalline diamond body may alternatively be formed from natural diamond grains and to have a higher diamond density, to thereby reduce the level of catalyst material in the body. In some applications, this may be considered to render it sufficiently thermally stable without the need for further treatment.

Removing the catalyst material (cobalt) from the polycrystalline diamond body results in increased heat resistance, but may also cause the diamond table to become more brittle. Accordingly, in certain embodiments, only a select portion or region (measured either in depth or width) of a diamond table is leached, in order to gain thermal stability without losing impact resistance. As used herein, thermally stable polycrystalline (TSP) diamond compacts include both partially and completely leached compounds. In one embodiment of the disclosure, it is desired that the selected thermally stable region for TSP diamond constructions of this disclosure is one that extends a determined depth from at least a portion of the surface, e.g., at least a portion of the top and side surfaces, of the diamond body independent of the working or cutting surface orientation.

In an example embodiment, it is desired that the thermally stable region extend from a top or side surface of the polycrystalline diamond body, having a thickness of 0.010 inches, an average depth of at least about 0.006 mm to an average depth of less than about 0.1 mm, preferably extend from a top or side surface an average depth from about 0.02 mm to an average depth of less than about 0.09 mm, and more preferably extend from a top or side surface an average depth of from about 0.04 mm to an average depth of about 0.08 mm. In other embodiments of the disclosure, the entire polycrystalline diamond compact layer may be leached. The exact depth of the thermally stable region can and will vary within these ranges for TSP diamond constructions of this disclosure depending on the particular cutting and wear application. The region remaining within the polycrystalline diamond body or compact beyond this thermally stable region is understood to still contain the catalyst material.

In one embodiment of the present disclosure, the selected portion or region of the polycrystalline diamond body to be rendered thermally stable includes the working or top surface of the polycrystalline diamond body, which extends along the upper surface of the polycrystalline diamond body, and extends to a selected depth into the diamond body from the working or top surface. Alternatively, the selected portion or region to be rendered thermally stable may include the working or top surface of the polycrystalline diamond body and/or a side surface, wherein the side surface is understood to be any surface substantially perpendicular to the upper (working or top) surface of the polycrystalline diamond body or compact. Extending the thermally stable region to along the side surface of the construction operates to improve the life of the body or compact when placed into operation, e.g., when used as a cutter in a drill bit placed into a subterranean drilling application. This is believed to occur because the enhanced thermal conductivity provided by the thermally stable side surface portion operates to help conduct heat away from the working or top surface, thereby increasing the thermal gradient of the thermally stable polycrystalline diamond body or compact, its thermal resistance, and service life.

In an example embodiment, the thermally stable region of the thermally stable polycrystalline diamond body or compact may extend along the side surface for a length of about 25 to 100 percent of the total length of the side surface as measured from the working or top surface. The total length of the side surface is that which extends between the working or top surface and an opposite end of the PCD body or, between the working or top surface and interface of the substrate or polycrystalline cubic boron nitride layer. In one embodiment of the present disclosure, the selected portion or region of the polycrystalline diamond body to be rendered thermally stable includes the working or top surface and/or a side surface of the polycrystalline diamond body, and extends to a selected depth into the diamond body from the working or top surface such that the untreated or remaining region within the diamond body have a thickness of at least about 0.01 mm as measured from the substrate and/or from the polycrystalline cubic boron nitride layer. Alternatively, the treated depth may extend entirely to the interface with the polycrystalline cubic boron nitride layer.

Additionally, when the polycrystalline diamond body to be treated is attached to a substrate, i.e., is provided in the form of a polycrystalline diamond compact, it is desired that the selected depth of the region to be rendered thermally stable be one that allows a sufficient depth of region remaining in the polycrystalline diamond compact that is untreated to not adversely impact the attachment or bond formed between the diamond body and the substrate or between the diamond body and the polycrystalline cubic boron nitride layer interposed between the diamond body and the substrate, e.g., by metal infiltration during the HPHT process. In an example embodiment, it is desired that the untreated or remaining region within the diamond body have a thickness of at least about 0.01 mm as measured from the substrate and/or from the polycrystalline cubic boron nitride layer. It is further understood that the diamond body has a specified thickness, which varies depending on such factors as the size and configuration of the compact and the particular compact application.

In an example embodiment, the selected portion or region of the polycrystalline diamond body is rendered thermally stable by removing substantially all of the catalyst material therefrom by exposing the desired surface or surfaces to acid leaching, as disclosed for example in U.S. Pat. No. 4,224,380, which is incorporated by reference and included herein. Generally, after the polycrystalline diamond body or compact is made by HPHT process, the identified surface or surfaces, e.g., at least a portion of the top or side surfaces, are placed into contact with the acid leaching agent for a sufficient period of time to produce the desired leaching or catalyst material depletion depth. In another embodiment, where the diamond body to be treated is in the form of a polycrystalline diamond compact, the compact is prepared for treatment by protecting the substrate surface, any exposed polycrystalline cubic boron nitride surface, and other portions of the polycrystalline diamond body adjacent the desired treated region from contact with the leaching agent. Methods of protecting such surfaces include covering, coating, or encapsulating the portions to be protected, such as those methods disclosed for example in U.S. Patent Publication No. 2006/0066390 A1, which is assigned to the present assignee and herein incorporated by reference in its entirety.

As mentioned above, a PDC cutter according to the present disclosure may have a non-planar interface between the carbide substrate and the polycrystalline cubic boron nitride layer thereon. In other embodiments, a PDC cutter according to the present disclosure may have a non-planar interface between the polycrystalline cubic boron nitride layer and the thermally stable polycrystalline diamond compact layer. A non-planar interface between the substrate and polycrystalline cubic boron nitride layer increases the surface area of a substrate, thus improving the bonding of the polycrystalline cubic boron nitride layer to it. Similarly, a non-planar interface between the polycrystalline cubic boron nitride layer and the thermally stable polycrystalline diamond layer increases the surface area of the polycrystalline cubic boron nitride layer, thus improving the bonding of the thermally stable polycrystalline diamond compact layer. In addition, the non-planar interfaces increase the resistance to shear stress that often results in delamination of the PDC tables.

One example of a non-planar interface between a carbide substrate and a diamond layer is described, for example, in U.S. Pat. No. 5,662,720, wherein an "egg-carton" shape is formed into the substrate by a suitable cutting, etching, or molding process. Other non-planar interfaces may also be used, for example, the interface described in U.S. Pat. No. 5,494,477. The substrate surface may be, for example, a sintered metal-carbide, such as tungsten carbide as in previous embodiments. According to one embodiment of the present disclosure, a polycrystalline cubic boron nitride layer is deposited onto the substrate having a non-planar surface.

In accordance with some embodiments of the disclosure, the interface between the polycrystalline diamond compact layer and the polycrystalline cubic boron nitride layer may be non-planar. In accordance with another embodiment of the disclosure, the interface between the first polycrystalline cubic boron nitride layer and the second polycrystalline cubic boron nitride layer may be non-planar. In accordance with yet another embodiment of the present disclosure, the interface between the polycrystalline cubic boron nitride layer and the thermally stable polycrystalline diamond compact layer may be non-planar. In accordance with other embodiments of the disclosure, both the interface between the substrate and the polycrystalline cubic boron nitride layer and the interface between the polycrystalline cubic boron nitride layer and the polycrystalline diamond compact layer may be non-planar. In accordance with yet other embodiments of the disclosure, the non-planar interfaces may have mismatched geometries.

Advantages of the embodiments of the disclosure may include one or more of the following. A PDC cutter including a thermally stable polycrystalline diamond compact layer, a polycrystalline cubic boron nitride layer, and a metal substrate would allow for greater bond strength to the substrate, preventing delamination while also allowing for the PDC cutter to be used at larger temperature range. A completely leached polycrystalline diamond compact layer allows for the presence of cobalt in the polycrystalline cubic boron nitride layer, which is juxtaposed to the substrate, while removing it from the polycrystalline diamond compact layer which contacts the earth formation. Additionally, a partially leached polycrystalline diamond compact layer allows for the presence of some cobalt while removing it from the region that would experience the greatest amounts of thermal expansion.

The gradient of thermal expansion coefficients between thermally stable polycrystalline diamond layer, the polycrystalline cubic boron nitride layer and the metal substrate reduces residual stresses in the PDC cutter and the incidents of delamination of the diamond layer by interposing a layer with a lower thermal expansion coefficient, as compared to the substrate, next to the diamond layer. Further, the residual components of the polycrystalline cubic boron nitride layer have a high affinity for cobalt, further contributing to the strength of the bonds between the substrate and the polycrystalline cubic boron nitride layer.

The non-planar interface between the substrate and the polycrystalline cubic boron nitride layer, and the non-planar interface between the polycrystalline cubic boron nitride layer and the thermally stable polycrystalline diamond compact layer allow for greater bonding between the layers and high resistance to shear stress that often results in delamination. Further, a PDC cutter having non-planar interfaces with mismatched geometries prevents cracking.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed:

1. A polycrystalline diamond compact cutter, comprising:

a thermally stable polycrystalline diamond layer formed from a polycrystalline diamond layer having substantially all of a binder material removed from at least a portion of the polycrystalline diamond layer;

a carbide substrate; and a polycrystalline cubic boron nitride layer interposed between the thermally stable polycrystalline diamond layer and the carbide substrate, wherein at least a portion of the polycrystalline cubic boron nitride layer is radially surrounded by the thermally stable polycrystalline diamond layer.

2. The polycrystalline diamond compact cutter of claim 1, wherein the thermally stable polycrystalline diamond layer extends from a top or side surface of the polycrystalline diamond layer an average depth of at least about 0.006 mm to less than about 0.1 mm.

3. The polycrystalline diamond compact cutter of claim 1, wherein the thermally stable polycrystalline diamond layer extends from a top or side surface of the polycrystalline diamond layer an average depth of about 0.02 mm to less than about 0.09 mm.

4. The polycrystalline diamond compact cutter of claim 1, wherein the thermally stable polycrystalline diamond layer extends from a top or side surface of the polycrystalline diamond layer an average depth of about 0.04 mm to about 0.08 mm.

5. The polycrystalline diamond compact cutter of claim 1, wherein the thermally stable polycrystalline diamond layer extends along a side surface of the polycrystalline diamond layer for a length of about 25 to 100% of the total length of the side surface.

6. The polycrystalline diamond compact cutter of claim 1, wherein the thermally stable polycrystalline diamond layer extends along the entire polycrystalline diamond layer.

7. The polycrystalline diamond compact cutter of claim 1, wherein the polycrystalline cubic boron nitride layer has a cubic boron nitride content of at least 70% by volume.

8. The polycrystalline diamond compact cutter of claim 1, wherein the polycrystalline cubic boron nitride layer comprises one of Al, Si, and a mixture thereof.

9. The polycrystalline diamond compact cutter of claim 1, wherein the polycrystalline cubic boron nitride layer further comprises at least one selected from a carbide, a nitride, a carbonitride, and a boride of a Group 4a, 5a, and 6a transition metal.

10. The polycrystalline diamond compact cutter of claim 1, wherein the polycrystalline cubic boron nitride layer comprises an inner region and an outer region differing in cubic boron nitride content.

11. The polycrystalline diamond compact cutter of claim 10, wherein the cubic boron nitride content of the outer region is greater than the cubic nitride content of the inner region.

12. The polycrystalline diamond compact cutter of claim 1, wherein the thermally stable polycrystalline diamond layer has a cutting edge with a thickness of at least 0.010 inches.

13. The polycrystalline diamond compact cutter of claim 1, wherein an interface between the carbide substrate and the polycrystalline cubic boron nitride layer is non-planar.

14. The polycrystalline diamond compact cutter of claim 1, wherein the polycrystalline cubic boron nitride layer has a cubic boron nitride content of at least 85% by volume.

15. The polycrystalline diamond compact cutter of claim 1, wherein the polycrystalline cubic boron nitride layer comprises an inner polycrystalline cubic boron nitride region and an outer polycrystalline cubic boron nitride region, and wherein the outer polycrystalline cubic boron nitride region has a cubic boron nitride content greater than the inner polycrystalline cubic boron nitride region.

16. The polycrystalline diamond compact cutter of claim 1, wherein an interface between the thermally stable polycrystalline diamond layer and the polycrystalline cubic boron nitride layer is non-planar.

17. The polycrystalline diamond compact cutter of claim 15, wherein an interface between the carbide substrate and the polycrystalline cubic boron nitride layer is non-planar.

18. A polycrystalline diamond compact cutter, comprising:

a thermally stable polycrystalline diamond layer formed from a polycrystalline diamond layer having substantially all of a binder material removed from at least a portion of the polycrystalline diamond layer;

a carbide substrate; and at least two polycrystalline cubic boron nitride layers interposed between the thermally stable polycrystalline diamond layer and the carbide substrate, wherein at least a portion of at least one of the at least two polycrystalline cubic boron nitride layers is radially surrounded by the thermally stable polycrystalline diamond layer.

19. The polycrystalline diamond compact cutter of claim 18, wherein the thermally stable polycrystalline diamond layer extends from a top or side surface of the polycrystalline diamond layer an average depth of at least about 0.006 mm to less than about 0.1 mm.

20. The polycrystalline diamond compact cutter of claim 18, wherein the thermally stable polycrystalline diamond layer extends from a top or side surface of the polycrystalline diamond layer an average depth of about 0.02 mm to less than about 0.09 mm.

21. The polycrystalline diamond compact cutter of claim 18, wherein the thermally stable polycrystalline diamond layer extends from a top or side surface of the polycrystalline diamond layer an average depth of about 0.04 mm to about 0.08 mm.

22. The polycrystalline diamond compact cutter of claim 18, wherein the thermally stable polycrystalline diamond layer extends along a side surface of the polycrystalline diamond layer for a length of about 25 to 100% of the total length of the side surface.

23. The polycrystalline diamond compact cutter of claim 18, wherein the thermally stable polycrystalline diamond layer extends along the entire polycrystalline diamond layer.

24. The polycrystalline diamond compact cutter of claim 18, wherein at least a portion of the at least two polycrystalline cubic boron nitride layers is radially surrounded by the thermally stable polycrystalline diamond layer.

25. The polycrystalline diamond compact cutter of claim 18, wherein the at least two polycrystalline cubic boron nitride layers have a cubic boron nitride content of at least 70% by volume.

26. The polycrystalline diamond compact cutter of claim 18, wherein at least one of the at least two polycrystalline cubic boron nitride layers comprises an inner polycrystalline cubic boron nitride layer and at least one of the at least two polycrystalline cubic boron nitride layers comprises an outer polycrystalline cubic boron nitride layer.

27. The polycrystalline diamond compact cutter of claim 21, wherein the outer polycrystalline cubic boron nitride layer has a cubic boron nitride content greater than the inner polycrystalline cubic boron nitride layer.

28. The polycrystalline diamond compact cutter of claim 18, wherein an interface between the carbide substrate and one of the at least two polycrystalline cubic boron nitride layers is non-planar.

29. The polycrystalline diamond compact cutter of claim 18, wherein an interface between the thermally stable polycrystalline diamond layer and one of the at least two polycrystalline cubic boron nitride layers is non-planar.

30. The polycrystalline diamond compact cutter of claim 18, wherein an interface between the at least two polycrystalline cubic boron nitride layer is non-planar.

31. The polycrystalline diamond compact cutter of claim 18, wherein at least one of the two polycrystalline cubic boron nitride layers has a cubic boron nitride content of at least 85% by volume.

* * * * *